United States Patent [19]

Föttinger et al.

[11] Patent Number: 4,581,286

[45] Date of Patent: Apr. 8, 1986

[54] ARTIFICIAL SPLIT SUEDE LEATHER AND A PROCESS FOR PRODUCING SAME

[75] Inventors: Walter Föttinger; Kurt Jörder, both of Weinheim; Karl-Heinz Morweiser, Birkenau; Erich Fahrbach, Weinheim, all of Fed. Rep. of Germany

[73] Assignee: Carl Freudenberg, Weinheim, Fed. Rep. of Germany

[21] Appl. No.: 728,827

[22] Filed: Apr. 30, 1985

[30] Foreign Application Priority Data

Jul. 14, 1984 [DE] Fed. Rep. of Germany ..... 3425989

[51] Int. Cl.[4] ..... B32B 27/00

[52] U.S. Cl. ..... 428/288; 427/299; 427/389.9; 427/394; 428/290; 428/331; 428/397; 428/904

[58] Field of Search ..... 428/288, 92, 290, 331, 428/397, 904; 427/299, 389.9, 394

[56] References Cited

U.S. PATENT DOCUMENTS 4,161,456 7/1979 Sinn et al. ..... 428/904

4,492,731 1/1985 Bankar et al. ..... 428/397

*Primary Examiner*—Marion C. McCamish

*Attorney, Agent, or Firm*—Felfe & Lynch

[57] ABSTRACT

An artificial split suede leather, especially for sport or casual style shoes, is a split, needled, nonwoven material of unshrunk fibers containing at least 20% polyamide fibers by weight of the fibers having a trilobate, Y-shaped cross section. In a process of making it, only needling is used for consolidating the fibers. A spherical filler may also be used.

12 Claims, No Drawings

ARTIFICIAL SPLIT SUEDE LEATHER AND A PROCESS FOR PRODUCING SAME

BACKGROUND OF THE INVENTION

The invention relates to an artificial split suede leather of nonwoven material for use in, especially, sport and casual style shoes and a process for producing it.

High-quality, microfiber, artificial split suede leather has long been known. It is popular for the manufacture of clothing but not for the manufacture sport and casual style shoes which are produced in large quantities because its generally-stable cost is considerably higher than the greatly-fluctuating price of split cowhide leather at least on downward price fluctuations and this is less tolerable in the production of shoes.

Therefore, there is a market need for a split suede leather-like material which can be obtained at a generally-favorable price, as well as with the uniform quality, appearance, and mechanical properties available from synthetic or artificial manufacture. The latter properties allow a synthetic product in continuous web form to be drawn directly from a roll thereof and cut or stamped into a pattern in several layers simultaneously. In the case of genuine leather, cutting a pattern from the hide must be done on a single hide layer to avoid blemishes and accommodate its shape. This is an expensive and time-consuming procedure and, thus, an obstacle to efficient production. Furthermore, it would be desirable for the mechanical properties of the synthetic to avoid the disadvantages of genuine leather, such as sensitivity to moisture, lack of color fastness, and non-machine-washability.

Fibers having a trilobate, Y-shaped cross section are described in *Handbuch der Textilverbundstoffe* by R. Krcma (1970) on pages 151 to 154. From this, and from French Pat. No. 1,439,288 (F.B. Mercer Ltd.), it is known to use such polyamide fibers for their advantageous effect on the loft and mechanical/physical properties of a needled nonwoven. However, the only areas of use described for the trade are for clothing, carpet tufting and hosiery. Suitability for artificial split suede leather is nowhere mentioned, nor is it obvious, on account of the different characteristics required for split suede leather-like material. Furthermore, the literature always mentions crimping and shrinking as important characteristics of such trilobate fibers.

SUMMARY OF THE INVENTION

It is, therefore, an object of the invention to provide an artificial split suede leather, especially for sport and casual shoes, which will satisfy the above-mentioned requirements for an alternative product at least not inferior to genuine split suede leather in its various properties and a process for its manufacture from relatively-inexpensive raw materials.

This and other objects are achieved in accordance with the invention by a split, nonwoven, consolidated only by needling, fiber-containing material. All of the fibers in the material have a fineness of from about 1.5 to about 6 decitex and are in a non-shrunk state. At least 20% of the fiber content of the material by weight of the fiber content before any impregnations is polyamide fibers having a trilobate, Y-shaped cross section.

The invention, however, expressly avoids shrinking and crimping any of the fibers in the material; it uses needling exclusively as the consolidating and compressing process because, otherwise, a product virtually equal to genuine split suede leather cannot be obtained. The disclosures of trilobate fibers cited above can, for this reason, in no way serve as a teaching for the solution of the stated problem. The artificial split suede leather resulting from this process of consolidating and compressing the specified, unshrunk fibers only by needling has a weight of from about 300 to about 2500 grams per square meter at a maximum thickness of no more than about 3 millimeters.

Preferably, the content of polyamide fibers of trilobate cross section in the needled nonwoven, before any impregnations, amounts to about 40 to about 60 percent by weight. The rest comprises fibers of round cross section, preferably polyamide and/or viscose fibers. Other, for example, cellulose fibers can also be contained, but all of these fibers must have a fineness of from about 1.5 to about 6 decitex, and none of it is allowed to be in a shrunk state. Polyester fibers are, however, unsuitable for the present invention; they are hard to dye and are not color-fast.

For the manufacture of the artificial split suede leather of the invention, a fiber mat of the above composition is needled and thus consolidated to about 0.15 to about 0.25 grams per cubic centimeter. Then it is further worked by methods commonly used in the production of artificial and natural leather, the material of the invention having, in preferred variants of the individual steps of the process, the following special advantages:

The known impregnations with aqueous latex mixtures of nitrile-butadiene rubber (NBR), styrene-butadiene rubber (SBR), acrylate or polyurethane can include, in accordance with the invention, in addition to the commonly used pigments, polyamide dyes on the basis of acids and/or metal complex compounds. If cellulose fibers are used, the addition of direct dyes is preferred. These dyes penetrate into the nonwoven of the invention, during coagulation and drying, in a surprisingly uniform manner and with high yields on the fibers.

The known fillers, such as chalk or barytes, can be added to the impregnating mixture.

In an especially advantageous variant of the process of the invention, microspheres of a silicate are used instead of these conventional fillers. These can be either hollow (air-filled) or solid. The preferred microsphere diameters range from about 5 to about 50 micrometers and, preferably, from about 10 to about 30 micrometers. In this variant, outstanding split-leather-like surface appearance, split-leather-like feel, and strength of adherence with polyurethane sole cements are obtained.

This is followed by splitting and grinding processes known in themselves and, chiefly for dark colors, an additional application of polyamide and, if appropriate, cellulose dye by printing or brushing, followed by steaming and drying. This is followed by a washing process which is followed by imbibing or splashing with an aqueous water-repellent agent. Surprisingly, it has been found that the conventional paraffin/zirconium salt emulsions commonly used for this do not impair, as they usually do, the strength of adherence to a polyvinylchloride or polyurethane sole attached by injection molding, but even improve it.

A product is thus obtained which is soft and pliant like genuine split leather. Visually, too, scarcely any difference can be detected. The artificial split suede leather of the invention can be made in all colors, even in very bright and light shades, such as white for example. The resistance to rub-off and color running is much better than in the case of genuine leather. The new material is absolutely color-fast against soft, white PVC (soles, linings, tongues, etc. attached by injection molding), i.e., there is no "bleeding" of the fiber colors into the adjoining PVC surfaces.

In contrast to genuine leather, good washability is also achieved and to be stressed as an advantage. The split suede leather imitate of the invention is, therefore, especially suitable for the manufacture of sport shoes (e.g., tennis shoes) which can be washed in the washing machine.

The following examples are intended to describe preferred processes for manufacturing the artificial split suede leather of the invention, without limiting the scope of the invention to the exemplary processes or products obtained.

EXAMPLE 1

A fiber mixture consisting of:

50% of trilobate, unmatted polyamide fibers of a fineness of 4.0 dtex/60 mm, and 50% of matted polyamide fibers of a fineness 1.7 dtex/40 mm, of normal, round cross section, by fiber weight is made into a nonwoven fabric mat by carding, cross-laying and needling until the mat has the following properties:

Weight per unit of area: 600 g/m$^2$.

Density: 0.17 f/cm$^3$.

Needling density: 1200 per cm$^2$.

This needled mat is then impregnated in a Foulard machine with a mixture of the following formula:

| | Parts | |
|---|---|---|
| | solid | liquid |
| acrylate-latex | 100.0 | 200.0 |
| pigment | 1.0 | 2.0 |
| Water | — | 86.0 |
| maleic acid | 0.5 | 0.5 |
| acid dye | 3.0 | 3.0 |
| Baryte powder | 100.0 | 100.0 |
| Chalk | 4.0 | 4.0 |
| leather dubbing | 21.0 | 30.0 |
| coagulation agent for later | 1.5 | 3.0 |
| Silicone | 8.0 | 10.0 |
| | 239.0 | 438.5 |

Solids content
G = 54.50% by weight.
The web absorption amounts to 300%.

The web of goods is then passed through a three-belt dryer where coagulation, application of the dye and drying take place.

Then the material is washed, split once in the middle, ground to a thickness of 1.5 mm, and made water repellent by Foularding with a paraffin-zirconium emulsion. Then it is dried.

A material is thus obtained which is extremely similar in feel and appearance to genuine split suede leather. It has the advantage over the latter that the color is brighter, more resistant to wear, and absolutely color-fast against white soft PVC.

The steam permeability measured by the Mitton method is 11.7 mg per sq. cm. per hour, i.e., greater than that of genuine leather. The product is completely washable.

EXAMPLE 2

A needled mat prepared as in Example 1 is impregnated with a mixture of the following composition:

| | Parts | |
|---|---|---|
| | solid | liquid |
| acrylate latex | 100.0 | 200.0 |
| pigment | 1.0 | 2.0 |
| Water | — | 86.0 |
| maleic acid | 0.5 | 0.5 |
| acid dye | 3.0 | 3.0 |
| microcapsule Z 600, diameter 12 micrometers | 100.0 | 100.0 |
| Chalk | 4.0 | 4.0 |
| leather dubbing | 21.0 | 30.0 |
| coagulation agent for later | 1.5 | 3.0 |
| Silicone | 8.0 | 10.0 |
| | 239.0 | 438.5 |

Solids content
G = 54.50% by weight.
The wet absorption amounts to 400%.
The rest of the processing is performed as in Example 1.

The material thus obtained is especially pliable and leather-like. The Mitton steam permeability is 10.2 mg per sq. cm. per hour. It is likewise machine washable.

It will be understood that the specification and examples are illustrative but not limitative of the present invention and that other embodiments within the spirit and scope of the invention will suggest themselves to those skilled in the art.

What is claimed is:

1. An artificial split suede leather, comprising:

a split, needled, nonwoven, fiber-containing material, wherein at least 20% of the fiber content by weight of the fiber content before any impregnations consists of polyamide fibers of trilobate, Y-shaped cross section, the material having a weight per unit of area of from about 300 to about 2500 g/m$^2$ and a maximum thickness of about 3 mm, and all of the fibers being unshrunk and uncrimped and having a fineness of from about 1.5 to about 6 dtex.

2. The artificial split suede leather of claim 1, wherein the percentage of polyamide fibers of trilobate cross section is from about 40% to about 60%.

3. Artificial split suede leather of claim 2, wherein some of the fibers contained in the material are round cross section fibers of polyamide, viscose or cellulose.

4. Artificial split suede leather of claim 1, wherein some of the fibers contained in the material are round cross section fibers of polyamide, viscose or cellulose.

5. A process for producing an artificial split suede leather, comprising:

providing a nonwoven mat of fibers, at least 20% of the fibers thereof by weight of the fibers consisting of polyamide fibers of trilobate, Y-shaped cross section and all of the fibers having a fineness of from about 1.5 to about 6 dtex;

consolidating and compressing the mat only by needling to about 0.15 to about 0.25 grams per cubic meter without shrinking or crimping the fibers thereof;

impregnating the compressed mat with an aqueous latex mixture suitable for artificial suede leathers; and at least splitting the impregnated mat after any necessary drying sufficient therefor.

6. The process of claim 5, wherein the impregnating aqueous latex mixture further comprises at least one of pigment colors and polyamide dyes of an acid or metal complex basis.

7. The process of claim 6, wherein the mat comprises cellulose fibers and the impregnating aqueous latex mixture further comprises direct dyes therefor.

8. The process of claim 7, wherein the impregnating aqueous latex mixture further comprises microspheres on a silicate basis with a diameter of from about 5 to about 50 micrometers for filling the artificial split suede leather.

9. The process of claim 6, wherein the impregnating aqueous latex mixture further comprises microspheres on a silicate basis with a diameter of from about 5 to about 50 micrometers for filling the artificial split suede leather.

10. The process of claim 5, wherein the mat comprises cellulose fibers and the impregnating aqueous latex mixture further comprises direct dyes therefor.

11. The process of claim 10, wherein the impregnating aqueous latex mixture further comprises microspheres on a silicate basis with a diameter of from about 5 to about 50 micrometers for filling the artificial split suede leather.

12. The process of claim 5, wherein the impregnating aqueous latex mixture further comprises microspheres on a silicate basis with a diameter of from about 5 to about 50 micrometers for filling the artificial split suede leather.

* * * * *